US005133370A

United States Patent [19]

Duffel

[11] Patent Number: 5,133,370

[45] Date of Patent: Jul. 28, 1992

[54] METHOD FOR CONSTRUCTION OF HAIRPIECE AND ARTICLE THEREOF

[76] Inventor: Dale L. Duffel, 7407 Marinette, Houston, Tex. 77074

[21] Appl. No.: 391,651

[22] Filed: Aug. 8, 1989

Related U.S. Application Data

[63] Continuation of Ser. No. 69,843, Jul. 6, 1987, abandoned.

[51] Int. Cl.[5] ..... A41G 5/00

[52] U.S. Cl. ..... 132/201; 132/53

[58] Field of Search ..... 132/201, 53, 54, 56

[56] References Cited

U.S. PATENT DOCUMENTS

| | | | |
|---|---|---|---|
| 1,635,099 | 7/1927 | Seilaz | 132/56 |
| 3,077,891 | 2/1963 | Lane | 132/201 |
| 3,189,035 | 6/1965 | Heck | 132/5 |
| 3,421,521 | 1/1969 | Rich, Jr. | 132/53 |
| 3,472,246 | 10/1969 | Ostrom | 132/53 |
| 3,483,875 | 12/1969 | Trissell | 132/53 |
| 3,589,376 | 6/1971 | Kohler | 132/201 |
| 3,626,954 | 12/1971 | Ostrom | 132/5 |
| 3,654,935 | 4/1972 | Brown | 132/53 |
| 3,848,612 | 11/1974 | Kohler | 132/53 |
| 4,453,555 | 6/1984 | Finamore | 132/201 |
| 4,456,019 | 6/1984 | Finamore | 132/201 |
| 4,625,739 | 12/1986 | Hamazaki | 132/54 |
| 4,688,584 | 8/1987 | Nilsen | 132/56 |
| 4,825,886 | 5/1989 | Allen | 132/53 |

*Primary Examiner*—Gene Mancene
*Assistant Examiner*—Adriene B. Lepiane
*Attorney, Agent, or Firm*—Banner, Birch, McKie & Beckett

[57] ABSTRACT

A method for constructing a capillary prosthesis, toupee or other form of hairpiece which conforms to the shape, exactly, of the cranium of the head of the person who is intending to wear it comprising:

a) preparing a negative mold from plaster of paris or the like, on the cranium, and allowing it to cure;
b) preparing a positive mold from the negative and allowing it likewise to cure;
c) placing on the positive a thermosetting sheet of plastic and applying heat and pressure to form the plastic to the configuration of the positive and trimming the excess plastic to thereby accomplish a first sjablon;
d) fitting the sjablon to the cranium of the person and ascertaining the high and low spots thereon;
e) using the sjablon in modifying the positive to neutralize high and low areas and making a subsequent sjablon, or sjablons, as necessary until no high or low areas are noted upon refitting on the cranium of the person;
f) affixing hair to the final sjablon so that there is produced a hairpiece which may be press-vacuum fitted to the cranium of the person so as to thereby obviate the need for adhesive and/or other connections between the hairpiece and the head.

6 Claims, 1 Drawing Sheet

METHOD FOR CONSTRUCTION OF HAIRPIECE AND ARTICLE THEREOF

This application is a continuation of application Ser. No. 07/069,843, filed July 6, 1987 abandoned.

BACKGROUND OF THE INVENTION

1. Field of the Invention

The invention herein pertains to a method for making a hairpiece, toupee or the like which conforms exactly to the cranium of the person who wears it.

2. Description of the Prior Art

There are numerous methods known for producing the configuration, in three dimension of the human head, and more particularly the cranium, in order to accomplish a wig, toupee, hairpiece or the like to be worn by the individual. Ordinarily these hairpieces are formed on an open network of fabric mesh, commonly known as "swiss silk" and to which a plurality of strands of hair are individually attached through commonly known knotting procedures. The fabric mesh is flexible and is attached to the wearer by an appropriate adhesive. In fact, the entire hairpiece can be folded and put into a pocket. Adhesively attached hairpieces however, are easily detached and despite commercially oriented representations that the wearer can do "just about anything", the reality of actual usage is quite to the contrary. Simply speaking, attachment is not reliable and as a result the industry has retreated to other methods of hair "replacement". These include "hair weaving" and "surgical implantation", both of which are either aesthetically temporary or expensive, or both. Due to the various deficiencies characterizing the products, referred hereto as "soft base hairpieces", numerous other efforts have been made in the prior art to construct wigs, toupees, and other forms of hairpieces which may be reliably worn by their user in substantially all human activities ranging from swimming to sleeping but none, upon best information and belief to the inventor hereof, have truly been able to honestly represent the accomplishment of a hairpiece that remains on the cranium of the person under substantially all circumstances.

Certain artisans in the prior art have contemplated that one method of accomplishing reliable attachment of a hairpiece to the cranium of the wearer would be to somehow produce a "vacuum" fit. This has the substantial inherent advantages of eliminating adhesives, obviating complex reweaving and forgiving the inconvenience, pain and expense of surgical implantation. The intention to accomplish this object is old and well known, but despite this fact a reliable and continuous vacuum attachment to the cranium has never been accomplished. One may see for example in U.S. Pat. No. 1,635,099, granted on July 5, 1927, that the inventor Seilaz conceived that "wigs adhere properly to the head only when they fit the shape of the head exactly so that air between the head and the wig escapes when the wig is placed on the head, and a vacuum is produced under the hood." The Seilaz method, though recognizing the possibility of a vacuum attachment, describes a "shaped part or form A" (FIG. 5) which fits the head exactly and consists of several superposed pieces of fabric 17 to 23. He then impregnates this fabric with rubber causing the fabric to retain the shape once given to it. The rubber however, is flexible and the vacuum seal, if any, between the cranium and a flexible, bendable rubber type of cap is easily broken and will not allow for continuous vacuum attachment. Moreover, such a hairpiece comprising sequential layers of rubber would be unbearably hot, uncomfortable and impractical. Furthermore, even Seilaz admits in his patent that the object to produce a vacuum is not likely accomplished. See column 2 of page 1 where the need for an adhesive is described.

SUMMARY OF THE INVENTION

Accordingly, an object of the present invention is to provide a method by which a hairpiece such as a wig or toupee may be manufactured to conform exactly to the shape of the cranium of the individual for whom it is made.

A further object of the invention is to provide a method by which a hairpiece can be manufactured to conform to the shape of the cranium of the wearer and which can be reliably and continuously worn without any adhesive means therebetween.

Still another feature and advantage of the invention resides in a method by which a hairpiece can be manufactured and worn reliably and continuously with no other connective means than that of the vacuum that exists between the cranium and the hairpiece.

Another feature and object of the invention resides in a method for creating a hairpiece which can be vacuum fitted or, alternately, adhesively connected, but which in either case is fitted specifically to the exact cranial configuration of the wearer.

Still another feature of the inventive method herein relates to the manner for ascertaining the hairline and to the method for measuring the cranium and transferring the hairline from the negative mold to the positive, and to the ultimate sjablon that constitutes the vacuum attached body of the hairpiece itself.

These and numerous other features and advantages of the invention will become readily apparent upon a careful reading of the following detailed description, claims and drawings wherein like numerals denote like parts in the several views and wherein:

DETAILED DESCRIPTION OF THE DRAWINGS

DETAILED DESCRIPTION

THE MOLDS

Figure 1:
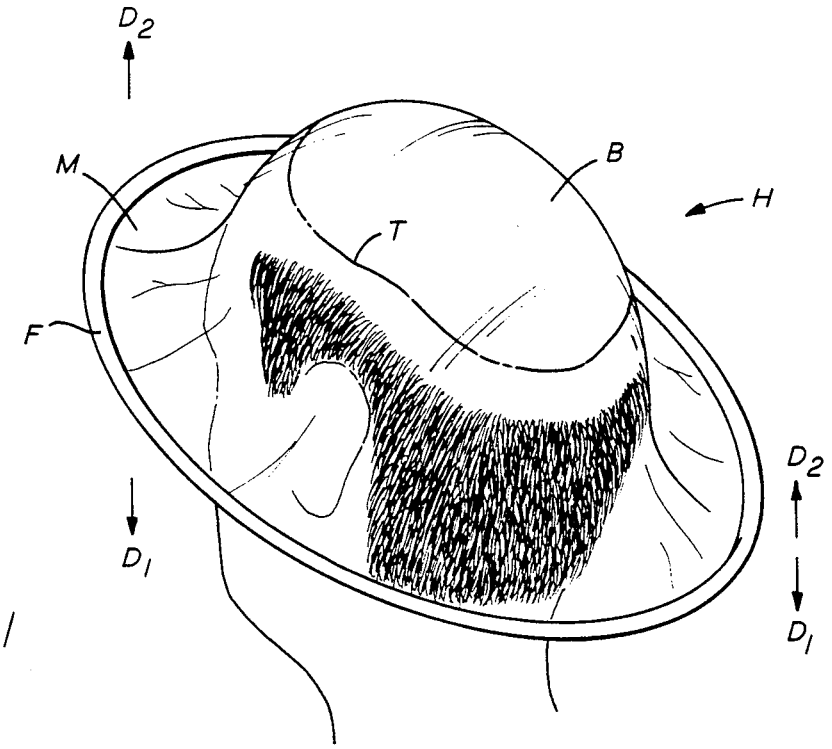
FIG. 1 shows the head of a person, prepared and delineated with the transfer marker.
Figure 2:
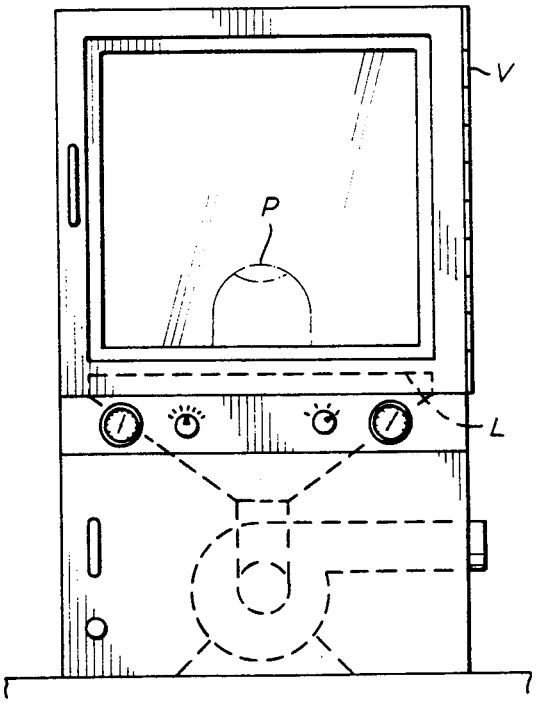
FIG. 2 illustrates application to and vacuum drawing of a thermo plastic sheet over a positive mold having a transfer marking thereon.

Referring now to FIG. 1 of the drawings, there is illustrated the head H of an individual having a balding area B which is intended to be covered by a hairpiece. According to the method described herein, it is generally necessary to prepare the head of the person to the extent of the portion thereof on which the sjablon, that is the vacuum cup, is to ultimately rest. This is accomplished in conventional and well known fashion and may include shaving of the primary balding area. After having shaved the skull, a stretchable, transparent or translucent membrane M, preferably of elastic material and which is characterized by a rigid metal framework F, generally of circular or elliptical configuration is placed upon the skull and gently pulled downwardly ($D_1$) so as to tighten the membrane M into close proximity throughout the contour of the cranium portion which it contacts. The elastic membrane operates to insulate the skull areas, and the head in general, from the wetness of the negative mold which is to be applied thereafter. The membrane M in effect fits the head H not unlike a drum surface which after placement on the skull and pulled downwardly is placed in tension so as to conform exactly to the skull configuration while providing a relatively comfortable environment for the person during the molding process. When the framework is pulled downwardly over the head and maintained in a taut position over the skull, the outline of the hair thereunder becomes more readily evident through the membrane M as the tension is applied and the technician may readily see exactly the bald portion B and where the ultimately prepared sjablon, that is the vacuum attachment skull cap, is to rest. When the general area of the bald spot is ascertained the outline of the hairline is drawn around the cranium with a crayon, ink markslot or the like, the line being applied on the flexible membrane itself thereby leaving no residual marking whatever on the head H. The line is referred to hereafter as the "transfer marker" T.

It is intended that the delineation of the transfer marker T will be transferred to the negative mold which is to be constructed on the membrane and thus enable an exacting recognition of the specific balding area on the negative mold itself.

While the stretchable membrane M is thus positioned, a plaster of paris mold (not shown) is begun on the skull of the subject. This is accomplished in conventional manner such as by the application of plaster of paris strips which are sequentially applied to the membrane covering the cranium to thereby form an ultimate negative mold. The negative mold is built to a thickness sufficient to establish its independent structural integrity when removed. When a sufficient thickness to the plaster of paris, or the like, mold is achieved it is simply removed from the cranium by a gentle upwardly directed motion ($D_2$) of the membrane. The negative mold is then allowed to cure until it is hardened. This may be accomplished in the open atmosphere or it may be accelerated by placing the negative into an oven.

Examination of the interior of the negative mold after it is removed from the membrane and before it may be placed in an oven reveals the presence of an image of the transfer marker T which had been traced around the membrane defining the bald area of the cranium to be covered by the hairpiece. This line is inherently transferred from the membrane to the negative mold as a result of the pressure applied by the plaster of paris strips onto the membrane. The transfer marker T advantageously produces an exact replica of the balding area of the cranium onto the negative mold itself.

After the mold is cured, the negative is filled with an appropriate molding material, again such as for example, plaster of paris or the like. This mold becomes a positive mold which, when cured, functions to act as a model upon which the sjablon will be constructed. Prior to filling the negative with the molding material however, it becomes advisable to again outline or reemphasize on it in black pen, crayon or the like the balding area which had been transferred from the flexible membrane. This enhancement of the transfer marker T will serve to facilitate transference from the negative mold to the positive although, depending upon the type of marker used it may be unnecessary to retrace this line on the negative mold before it is filled. After the positive has partially cured within the negative, it is removed therefrom and allowed to cure either in open air or in an appropriate oven if, acceleration of the cure time is desired. Upon removal, the transfer marker circumscribed about the cranium will again be visible and there is thus produced an exact replica not only of the cranium but of the balding area present thereon. This transfer marker T may, for purposes of emphasizing its definition and permanence on the positive, be carved out or recessed through use of a knife or other sharp instrument. The area circumscribed serves to accurately represent the dimensions and topographical configuration of the bald area on which the sjablon is to be vacuum fitted.

The Sjablons

Figure 3:
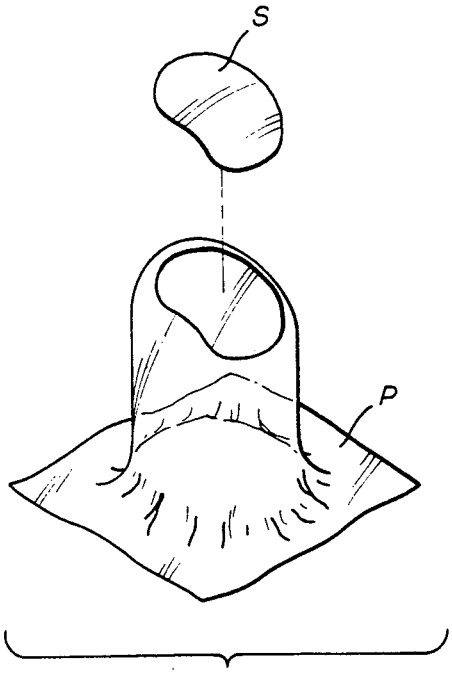
FIG. 3 illustrates the position of the sheet on the positive after forming and with a portion thereof, namely the sjablon removed thereafter.

Successful preparation and suction or vacuum attachment of the sjablon, that is the skull cap, upon which the hair base is to be ultimately attached, is dependent upon the accuracy with which its shape matches that of the cranium for which it is made. The first step in preparation of the sjablon consists of the application of a thin, in the range of about 0.015 or 0.020 millimeters thick, polyurethane, or other thermoplastic or the like sheet P over the entire cranial surface of the positive mold. The plastic sheet must be of sufficient dimensions to rest not only over the surface of the positive mold but to lie, at rest, on the base support L thereunder so that the excess of the plastic sheet P in effect forms a skirt around the base see FIG. 3. The positive mold and the plastic sheet thereover are then advantageously placed within a vacuum machine V. With the positive mold disposed in upright position and the plastic sheeting P displayed thereover with the extremities of the plastic sheeting resting on the grate of the vacuum machine V, a vacuum is drawn so as to attract and draw the skirt area of the sheet downwardly, thus tightly compressing the sheet P against the surface of the positive mold. Simultaneously, appropriate heat is applied within the vacuum machine so as to substantially instantly induce a thermoplastic of the sheet over the positive to thus achieve a configuration substantially identical to that of the positive mold. Care must be taken to assure that the sheet P is drawn completely over at least the cranium portion of the positive mold defined by the transfer marker T or indentation for, as previously described, the area circumscribed by this marker and which is thereafter covered by the plastic sheet defines the sjablon S made from the sheet itself. The positive mold and vacuum formed sheet are then withdrawn from the vacuum-oven V and the formed-plastic sheet is removed therefrom the mold. The plastic sheet is thereafter trimmed to remove all of the excess skirt externally of the transfer marker T. The resulting body constitutes the "first sjablon", (FIG. 3). (It is referred to as the "first sjablon" S because the "fitting" process (described hereafter) for vacuum attachment generally requires manufacture of two to seven or more sjablons until the "perfect" fit necessary for vacuum fit is accomplished).

Sjablon Fitting

At this point the "fitting" process begins. The first sjablon is placed upon the cranium of the subject from which the original negative mold was made. "High"

and "low" spots are evident. In order to emphasize the location of "high" and "low" spots it is advisable to wet the interior of the sjablon with a light water mist, such as a pump spray, in order to produce bubbles. The dampened sjablon is thus disposed over the cranium and pressed thereon. Because of the relatively accurate fit of the sjablon very few if any "irregular" (high and/or low spots) will appear but it is likely that some irregularities may appear upon application of the first sjablon. A high spot noted on the transparent or translucent sjablon will manifest itself in the form of an "edge bubble" which can, with the application of finger pressure to the sjablon exterior, be moved around. This examination and movement is to be followed by delineation of the high spot with a black maker or ink pen or the like on the external surface of the sjablon. Likewise, low spots in the sjablon will generally appear as a bubble which, unlike a "high spot", is not easily moved from one area to another. Reasonable practice following these basic guidelines will enable the practitioner to detect and isolate high and low spots in the sjablon. It is important to the invention that these high and low spots in the sjablon be discovered and delineated for otherwise the ultimate accomplishment of a perfect fit or of a vacuum fitted sjablon will not be readily accomplished. The accuracy with which these imperfections are located and corrected is directly related to the efficiency in the preparation of the final vacuum formed hairpiece or merely in the preparation of a superior fitted hairpiece that does not even reach vacuum attachment quality. In either event, when the imperfections in the sjablon are determined the "marked" sjablon is removed and "finishing work" on the positive is begun prior to preparation of the second sjablon.

Preparation of a second sjablon is initiated in the event that high and/or low spots occurred upon attempted vacuum attachment of the first sjablon to the cranium. When the high and/or low spots are delineated on the sjablons it is removed from the cranium and the identified areas are ascertained on the positive, and improvements to the positive are initiated before a second sjablon is produced. These improvements are accomplished by placing the first sjablon on the positive and circumferentially noting or otherwise circumscribing the high and low spots on the positive directly from the marked sjablon. The first sjablon is then removed and the high spots are sanded and the low spots filled. Sanding of the improved positive is accomplished before a second plastic sheet, like the first one, is applied to the positive, allowing a skirted area to exceed the dimensions of the positive and to rest on the surrounding supporting table. Like in the first sjablon production described above, the entire assembly of the positive and plastic sheet are placed within a vacuum oven and the vacuum is then pulled. Thereafter, the steps as described above are followed, namely, that the positive and plastic sheet are removed and thereafter the plastic sheet is trimmed so that the skirted portion below the transfer marker is shorn away, leaving the second sjablon. As previously described, the second sjablon is then sprayed with a mist of water, alcohol or the like and placed upon the cranium of the subject. Pressing of the sjablon onto the head soon reveals the presence of high and low spots, if any, as described above, and similarly, the same sequential steps are followed in order to thereafter improve the fit of the sjablon by identifying, circumscribing and removing the high and low areas. It may be possible that an ultimate sjablon is accomplished in the second process of a sjablon as here described, but it is not unlikely that three, or as many as seven or more sjablon preparations may be accomplished before a vacuum or otherwise desirable "fit" of the sjablon is accomplished on the cranium of the subject.

The Hair

The hair constituting a part of the hairpiece is used either in the form of hair plugs or individual hairs, each of which are hand sewn to a silk or otherwise soft covering or base. The silk piece or vegetable bedding as it may be referred to is cut to approximate the shape of the sjablon, but with the edge portions adapted to extend substantially beyond the edge of the sjablon. The hair is fastened and/or knotted to the netting but the specific knot, if any, for attaching the hair to the net does not constitute a part of the invention herein. In accordance with the invention though, the net, or gauze like material is paced upon a model head, preferably of the type made from spun aluminum, after the gauze or netting is cut to the approximate configuration as described above. In a preferred form however, a thin plastic spray is applied to the aluminum head and the gauze laid thereover. Thereafter another thin layer of plastic is sprayed or otherwise hand painted onto the netting, all while the laminated sequence of materials rests upon the aluminum head. The hair, which is attached to the gauge or netting is chosen to match existing hair of the subject and is prepared in an aesthetic style consistent with the choice of the subject also. It is generally hand-sewn with thread into the cross weaving of the gauze and knotted or similarly attached thereon. When this is completed the hairpiece, absent the sjablon, is removed from the aluminum head and a last spraying of plastic is applied to the interior thereof in order to facilitate coverage of the knots, netting and hair on the underside. The plastic preferably used would be spray polyurethane. When the assembly has cured, the hair/netting assembly is adhesively connected to the external surface of the final sjablon.

The vacuum fitted hairpiece thereafter is readily applied by the subject without assistance. He need merely orient the hairpiece to the proper position on the head and apply pressure with the hands downwardly in order to expel all air from between the sjablon and the cranium. Vacuum attachment is naturally facilitated by a cleanly shaven head and this preliminary step is therefore recommended. The hairpiece of the invention may be worn in substantially all activities without concern for separation from the cranium. The integrity of the attachment has been found reliable in the most vigorous of activities including various forms of athletics and the like.

Numerous modifications to the invention herein may be made without departing from the spirit hereof or from the scope of the claims. For example, the hairpiece could be attached by a plurality of sjablons such as one or more at the front and rear of the cranium. These and numerous other modifications to the invention are deemed to be within the scope of the appended claims.

What is claimed is:

1. A method of manufacturing a hairpiece for the specific and individual use of one person on whose cranium the hairpiece is adapted to be suction fitted in vacuum-like fashion comprising the steps of:

a) preparing the head of the person for receipt of a negative mold thereover including the preparatory step of marking the balding area with a transfer marker;

b) applying the negative mold material to the cranium allowing it time to partially cured and removing it thereafter to reveal the balding area marker;

c) preparing a positive mold from the negative mold while simultaneously transferring the marker to the positive mold, and curing the positive mold preparatory to its use for preparation of a first semi-rigid sjablon;

d) deploying a plastic sheet over the positive mold and inducing a heat setting of the sheet to the exact configuration of the positive mold to thereby initiate formation of the first sjablon;

e) trimming the first sjablon along the demarcation of the balding area marker to thereby create a first semi-sjablon;

f) placing the first semi-rigid sjablon of step (e) on the cranium of the person from whom it was made and pressing thereon to determine and identify the presence of high and low spots in the manifesting form of air pockets existing between the cranium and the internal surface of the sjablon;

g) marking exteriorly on the sjablon said air pockets and using the marked sjablon to modify the positive mold by appropriately sanding high spots and/or filling low spots thereon to eliminate air pockets in the subsequent sjablon;

h) deploying a second plastic sheet over the positive mold and inducing a heat setting of the sheet to the exact configuration of the positive mold to thereby initiate formation of the second sjablon;

i) trimming the second sjablon along the demarcation of the balding area marker to thereby create a second semi-rigid sjablon;

j) placing the second semi-rigid sjablon on the cranium of the person from whom it was made and pressed thereon to determine and identify the presence of high and low spots in the manifesting form air pockets existing between the cranium and the internal surface of said second semi-rigid sjablon;

k) marking exteriorly on said second semi-rigid sjablon said air pockets, if any, and using the marked sjablon to modify the positive mold by appropriately sanding high spots and/or filling low spots thereon to eliminate air pockets in the subsequent sjablon;

l) repeating the steps of placing the sjablon on the cranium, pressing and marking air pockets and marking another sjablon until a perfect fitting setting-rigid sjablon manifesting no air pockets is obtained; and m) affixing hair to the perfect fitting semi-rigid sjablon to thereby create a hairpiece which is characterized by an internal semi-rigid sjablon which rests on the cranium in more precise conformity to the shape thereof due to the further fitting steps of f) through l).

2. The method of claim 1 wherein the plastic sheet is capable of allowing for visual identification of the transfer marker from the exterior to the interior thereof thereby enabling trimming of the sjablon to the proper dimensions of the person from whose cranium it was made.

3. The method of claim 1 wherein the plastic sheet is vacuum drawn over the positive in a vacuum oven.

4. The invention of claim 1 wherein the method includes the additional step of pressing the hairpiece upon the cranium so as to eliminate all air pockets between the cranium and the sjablon and thus achieve a vacuum-suction fit between the hairpiece and cranium.

5. The invention of claim 4 wherein the sjablon is smaller than the surface area of the cranium but sufficiently large to accomplish vacuum fit of the hairpiece thereon.

6. The invention of claim 5 wherein a plurality of sjablons are made at different areas of the cranium in accordance with the method herein, and attached said sjablons to a common hairpiece to provide multiple vacuum attachments to the cranium.

* * * * *